United States Patent [19]

DeFord et al.

[11] 4,298,496

[45] Nov. 3, 1981

[54] HIGHLY STABLE AEROSOL GENERATOR

[75] Inventors: Henry S. DeFord; Mark L. Clark, both of Kennewick, Wash.

[73] Assignee: The United States of America as represented by the United States Department of Energy, Washington, D.C.

[21] Appl. No.: 188,435

[22] Filed: Sep. 19, 1980

[51] Int. Cl.[3] ..... B01F 3/04

[52] U.S. Cl. ..... 252/359 A; 239/338; 261/78 A

[58] Field of Search ..... 261/78 A, DIG. 65; 252/359 A, 359 CG; 239/338; 128/200.21

[56] References Cited

U.S. PATENT DOCUMENTS

| | | | |
|---|---|---|---|
| 638,481 | 12/1899 | Seltzer | 239/338 X |
| 692,485 | 2/1902 | Seltzer | 239/338 X |
| 692,721 | 2/1902 | Seltzer | 239/338 X |
| 1,176,669 | 3/1916 | Endres et al. | 239/338 X |
| 2,605,088 | 7/1952 | Dautrebande | 252/359 A X |
| 2,675,214 | 4/1954 | Wendell, Jr. | 252/359 A |
| 2,686,160 | 8/1954 | Kell et al. | 252/359 CG |
| 3,384,103 | 5/1968 | Lansky | 261/78 A X |
| 3,864,326 | 2/1975 | Babington | 261/78 A X |
| 4,198,969 | 4/1980 | Virag | 261/78 A X |
| 4,201,276 | 5/1980 | Bardin et al. | 252/359 A X |

OTHER PUBLICATIONS

Berke et al., "An Improved Aerosol Generator", *American Industrial Hygiene Assoc. Journal 36*, 43, (1975).

Lauterbach et al., "An Improved Aerosol Generator", *A.M.A. Archives of Industrial Health 13,* 156, (1956).

Liu et al., "An Aerosol Generator of High Stability", *American Industrial Hygiene Assoc. Journal 36,* 861, (1975).

*Primary Examiner*—Richard L. Chiesa

*Attorney, Agent, or Firm*—Paul A. Gottlieb; Richard G. Besha; James E. Denny

[57] ABSTRACT

An improved compressed air nebulizer has been developed such that a uniform aerosol particle size and concentration may be produced over long time periods. This result is achieved by applying a vacuum pressure to the makeup assembly and by use of a vent tube between the atmosphere and the makeup solution. By applying appropriate vacuum pressures to the makeup solution container and by proper positioning of the vent tube, a constant level of aspirating solution may be maintained within the aspirating assembly with aspirating solution continuously replaced from the makeup solution supply. This device may also be adapted to have a plurality of aerosol generators and only one central makeup assembly.

4 Claims, 2 Drawing Figures

HIGHLY STABLE AEROSOL GENERATOR

CONTRACTUAL ORIGIN OF THE INVENTION

The United States Government has rights in this invention pursuant to Contract No. EY-76-C-06-1830 between the U.S. Department of Energy and Battelle Pacific Northwest Laboratories.

BACKGROUND OF THE INVENTION

This invention concerns an improvement in nebulizers used for production of aerosols of uniform solution concentration and particle size. Commercial nebulizers deliver an unstable output of aerosol spray, primarily due to changes in solution concentration. This unstable output originates from evaporation processes occurring within the nebulizer. Droplet evaporation can take place due to elevation of vapor pressure from curved surfaces internal to the nebulizer and also due to reduction in the dew point of the air stream used to atomize the solution when the air stream is expanded to atmospheric pressure. Such evaporation leads to a spectrum of droplet sizes, some of which pass through the nebulizer system with the remainder of the droplets returning to the solution reservoir. Since some of the solvent is evaporated and passed through the nebulizer, the remaining solution undergoes a continuous increase in concentration which causes a constantly changing aerosol output.

Various methods have been employed to solve this instability in aerosol output. These approaches have primarily been directed toward correction of the increasing solution concentrations arising from the evaporation processes. In H. L. Berke and T. E. Hull, *American Industrial Hygiene Association Journal,* 36, 43 (1975), an aerosolizer is described, which has the ability to compensate for changes in concentration and volume of solution by adjustments to the pressure and temperature of the air jet used to atomize the solution. This device produces a fluctuating nebulizer solution concentration but does yield a stable mean aerosol concentration. In K. E. Lauterbach, A. D. Hayes, and M. A. Coelho, *A. M. A. Archives of Industrial Health,* 13, 156 (1956), a device is described which circulates the solution to be atomized between an aspirating and storage reservoir, but the device has no provision to alleviate the detrimental effects evaporation has on the solution concentration. In B. Y. H. Liu and K. W. Lee, *American Industrial Hygiene Association Journal,* 36, 861 (1975), a device is described which supplies a constant flow of liquid to the nebulizer. Fresh liquid is constantly supplied to the atomizer and excess liquid collected is not recirculated; as a result, the system does produce a stable aerosol output. However, this device has relatively complicated components and does not conserve or use all of the aspirating solution. Therefore, there is currently no nebulizer which provides a non-fluctuating and uniform aerosol spray output without the use of complicated support systems.

It is therefore an object of the invention to provide a simple aerosol spray device for producing a uniform aerosol spray output.

It is an additional object of the invention to provide an aerosol spray device with a vacuum means applied to the makeup assembly which permits the level of the solution in the aspirating assembly to be adjusted with respect to the makeup solution to stabilize the aerosol output.

It is a further object of the invention to provide an aerosol spray device with the bottom of an air vent tube positioned within the makeup assembly such that the solution within the aspirating assembly is maintained at the same level as the bottom of the vent tube.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The invention relates to an aerosol generating device which produces an unvarying output of solute concentration in uniform size droplets or particles. The long term stability of the aerosol parameters is obtained by feeding solution from a makeup assembly to an aspirating assembly as aspiration of the solution takes place. The aspirating assembly solution is maintained at an optimum fluid level with respect to the makeup solution fluid level by the action of a vacuum applied to the makeup assembly in conjunction with an atmospheric vent tube in communication with the makeup assembly solution.

DETAILED DESCRIPTION OF THE PREFERRED EMBODIMENT

Figure 1:
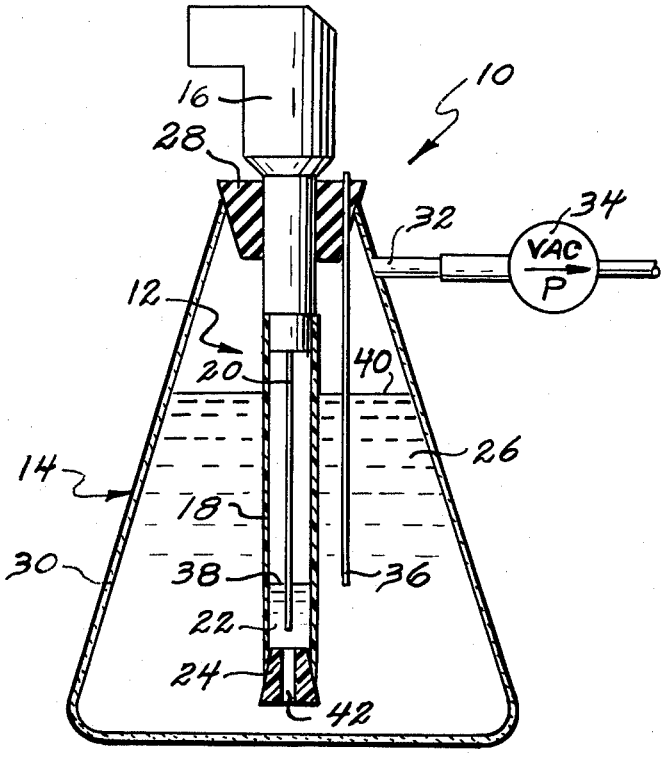
FIG. 1 illustrates an aerosol generator with concentric aspirating assembly and makeup assembly.
Figure 2:
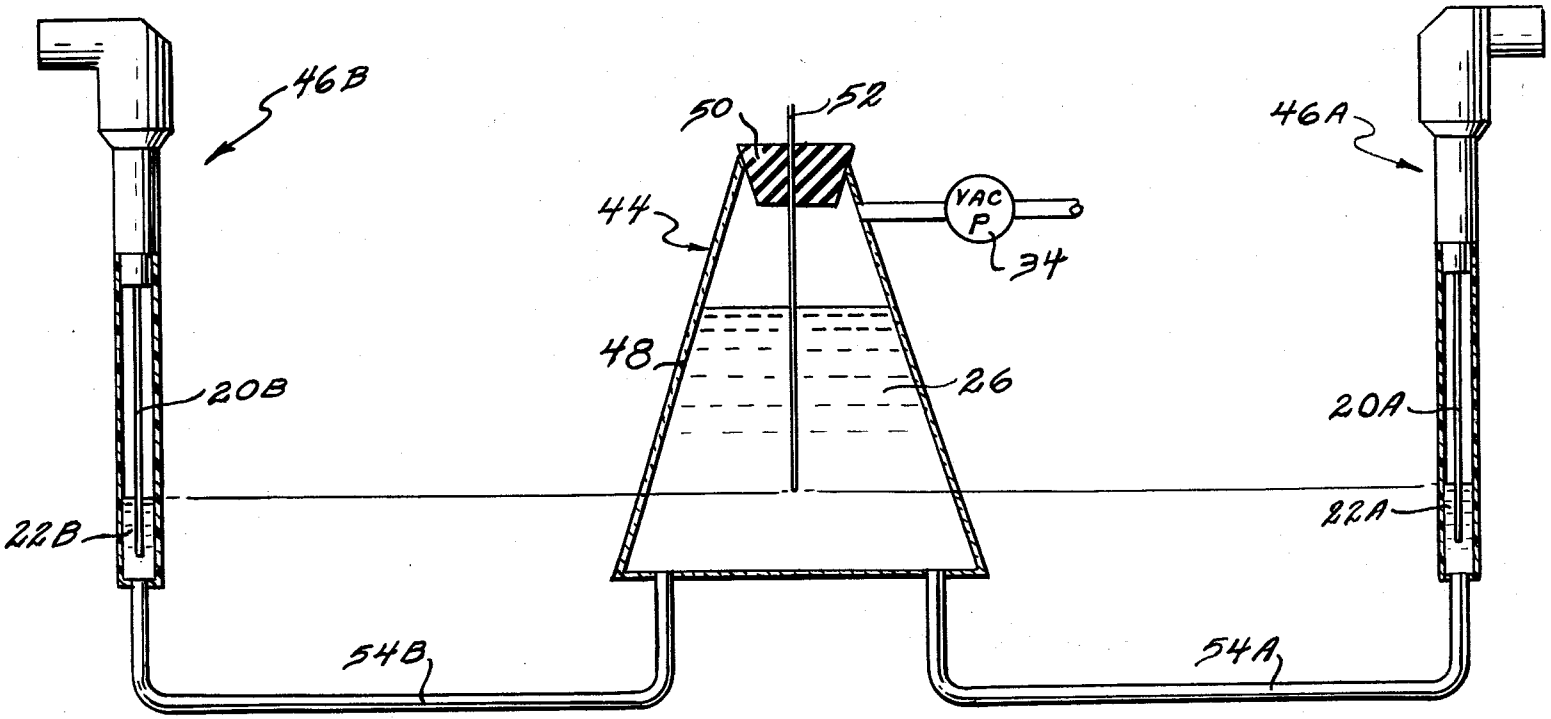
FIG. 2 illustrates two aerosol generators with one makeup assembly in communication with two separate aspirating assemblies.

FIGS. 1 and 2 illustrate alternative configurations for the preferred embodiment of the invention. FIG. 1 shows the preferred arrangement for a single aerosol generator, and FIG. 2 illustrates the preferred configuration for a system having a plurality of aerosol generators. As shown in FIG. 1, nebulizer assembly 10 comprises inner nebulizer assembly 12 and outer nebulizer assembly 14. Inner nebulizer assembly 12 contains nebulizer 16, which has been attached to aspirating cylinder 18 with aspirating tube 20 extending from nebulizer 16 into aspirating solution 22. At the open end of aspirating cyliner 18 is inner assembly stopper 24 having an opening into makeup solution 26 which is contained within outer nebulizer assembly 14. Inner nebulizer assembly 12 is placed within outer nebulizer assembly 14 by insertion of assembly 12 through outer assembly stopper 28. Outer nebulizer assembly 14 comprises container 30 holding makeup solution 26, and container 30 has vacuum pumping arm 32 with vacuum pumping means 34 attached thereto. Outer assembly stopper 28 not only acts to support inner nebulizer assembly 12 but also effectuates a vacuum seal to the opening of container 30 and to the outer surface of inner assembly 12.

Stopper 28 also accepts vent tube 36 which is open to the atmosphere at one end and extends into makeup solution 26 at the other end. Vent tube 36 is positioned in order to establish the appropriate aspirating solution level 38 relative to the makeup solution level 40. The lower end of vent tube 36 extends to the desired aspirating solution level 38 with vacuum pumping means 34 applying a pressure sufficient to initiate bubble formation at the bottom of vent tube 36. Therefore, vent tube 36 acts to position the aspirating solution level 38 by balancing the vacuum pressure forces applied by means 34 and the air column pressure above the aspirating solution 22. It is also possible to provide selected gas atmospheres via tube 36 for solutions particularly sensitive to long term exposure to ambient atmosphere.

During generation of aerosol from assembly 10, the aspirating solution level 38 within aspirating cylinder 18 is held constant by maintaining the vacuum pressure above makeup solution 26. Solution level 38 cannot be reduced below the position established by the bottom of vent tube 36 since any excessive vacuum applied by means 34 would only cause air to be pulled through vent tube 36. As a consequence of this pressure balance, the aspirating solution 22 is removed by aspirating tube 20 for generation of aerosol by nebulizer 16 with solution 22 continuously being replaced from makeup solution 26 through stopper passageway 42 in inner assembly stopper 24. This results in maintenance of a constant solution level 38. Though some concentration of solute in the solvent of aspirating solution 22 does initially take place, an equilibrium concentration is rapidly attained resulting in a uniform aerosol concentration and droplet or particle size.

The performance of the improved nebulizer 16 was compared with a standard commercially available nebulizer using 0.1% NaCl in distilled water as the aerosol solution. The change in concentration of aspirating solution 22 and makeup solution 26 was monitored by the change in electrical conductivity over a four-hour period of nebulizer operation. The standard commercially available nebulizer exhibited a linear increase of approximately 15% in conductivity from 0 to 4 hours operating time. By comparison, nebulizer assembly 10 of the applicants produced a 5% transient increase from 0 to 1.0 hours of operation with a constant level of conductivity maintained from 1 to 4 hours of operation.

In FIG. 2 is illustrated an alternative embodiment which permits a single makeup assembly 44 to supply makeup solution to a plurality of aspirating assemblies 46. In this configuration, aspirating assembly 46A need not be within makeup assembly 44 to produce a uniform aerosol output. Functionally, the system shown in FIG. 2 performs in the same fashion as shown in FIG. 1 with the structural elements repositioned. This provides more freedom in placement of nebulizers 16 and allows a large number of nebulizers 16 to draw from only one makeup assembly 44.

Makeup assembly 44 is composed of fluid receptacle 48 with receptacle stopper 50 effecting a vacuum seal to the opening of receptable 48 and to second vent tube 52 which passes through stopper 50 into makeup solution 26. In order to interconnect makeup solution 26 with aspirating solution 22A in assembly 46A, interconnect tubing 54A acts as an interconnection means by passing from receptacle 48 to the bottom of aspirating assemblies 46A. By application of a vacuum to fluid receptacle 48 through vacuum pumping means 34 and by proper positioning of second vent tube 52, optimum pressure conditions may be established in the same manner as discussed for the structure of FIG. 1. This procedure insures a fixed level for aspirating solution 22 and thereby produces a uniform aerosol output. As a consequence, this configuration permits a uniform aerosol spray to be produced by a plurality of aspirating assemblies 46 which may be remotely positioned with respect to single makeup assembly 44.

The embodiment of the invention in which an exclusive property or privilege is claimed are defined as follows:

1. An aerosol spray device comprising, an aspirating assembly, a makeup assembly capable of containing a makeup solution and capable of being vacuum sealed, a vacuum pressure means attached to said makeup assembly and capable of introducing a vacuum into said makeup assembly, an interconnection means for coupling said aspirating assembly and said makeup assembly, said interconnection means capable of allowing communication between solutions introduced into said aspirating assembly and said makeup assembly and a vent tube open at each end with one end in communication with the atmosphere and the other end of said vent tube in communication with the inside of said makeup assembly capable of containing a makeup solution.

2. The device of claim 1, wherein a plurality of said aspirating assemblies are capable of being interconnected to one of said makeup assemblies.

3. The device of claim 1, wherein said aspirating assembly is capable of being positioned within said makeup assembly.

4. The device of claim 1, wherein said interconnection means is a stopper positioned in the bottom of said aspirating assembly, said stopper having an opening passing therethrough.

* * * * *